United States Patent [19]

Emmett

[11] Patent Number: 4,485,739

[45] Date of Patent: Dec. 4, 1984

[54] DETONATION GAS DELIVERY UNIT

[75] Inventor: George C. Emmett, Frederick, Md.

[73] Assignee: H. L. & A. G. Balsinger, Inc., Bridgeville, Pa.

[21] Appl. No.: 471,337

[22] Filed: Mar. 2, 1983

[51] Int. Cl.[3] ..... F42C 15/28

[52] U.S. Cl. ..... 102/200; 102/275.9; 102/301; 102/313; 137/606

[58] Field of Search ..... 102/200, 275.9, 301, 102/313; 137/606

[56] References Cited

U.S. PATENT DOCUMENTS

| | | | |
|---|---|---|---|
| 3,841,344 | 10/1974 | Slack | 137/606 X |
| 3,885,499 | 5/1975 | Hurley | 102/275.9 |
| 3,939,772 | 2/1976 | Zebree | 102/275.9 |
| 4,056,059 | 11/1977 | Zebree | 102/200 |
| 4,073,235 | 2/1978 | Hopler, Jr. | 102/200 |
| 4,084,603 | 4/1978 | Howard | 137/606 X |

*Primary Examiner*—Peter A. Nelson
*Attorney, Agent, or Firm*—William J. Daniel

[57] ABSTRACT

The detonation gas for gas-detonatable blasting charges used in surface mining and the like is supplied by a portable self-contained delivery unit connected to the blasting charges by a network of small flexible tubing, which unit blends pressurized fuel and oxidizing gases from separate supply sources in predetermined proportions and regulates the separate flows of such gases in response to the backpressure imposed by the tubing network to maintain such proportions in the gas blend delivered to the tubing network. The separate gas flows are controlled by servo-actuated flow control valves actuated by a control gas pressure which is applied or released in response to such backpressure. Preferably, the control gas pressure is regulated by a pair of pilot valves, one normally open and the other normally closed, connected in parallel between the servo actuators of such flow control valves and the control gas source and the atmosphere, respectively, the state of the pilot valves being reversed in response to the occurrence of a backpressure exceeding a predetermined maximum to disconnect the control gas from and release the existing gas pressure on the flow control valve servo actuators. A preferred safety feature assures complete filling of the tubing network before the gas therein can be ignited to initiate detonation of the explosive charges.

9 Claims, 13 Drawing Figures

FIG. 1.
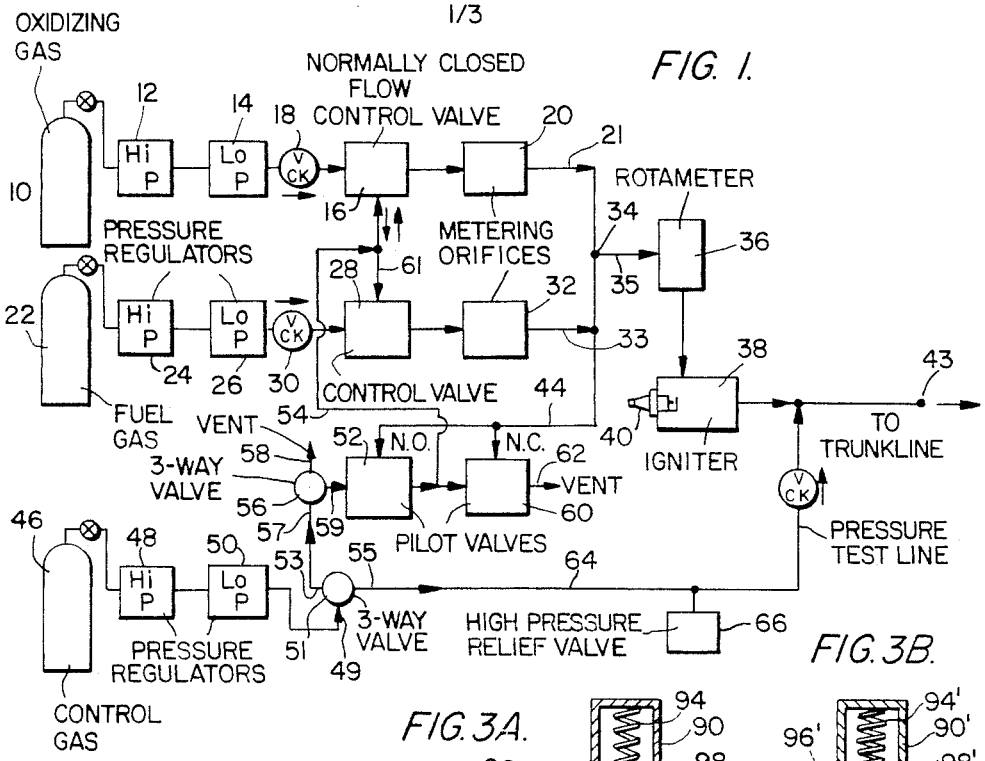
FIG. 3A.
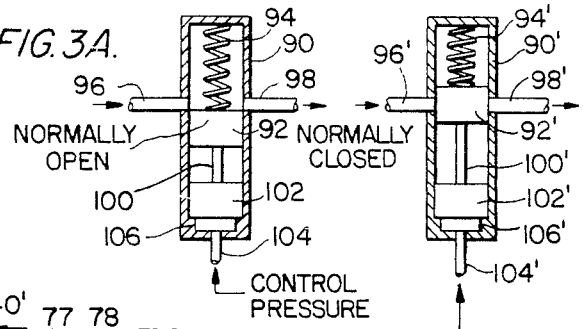
FIG. 3B.
FIG. 2.
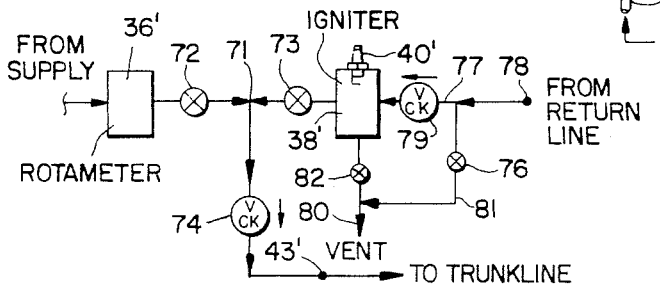
FIG. 5A.
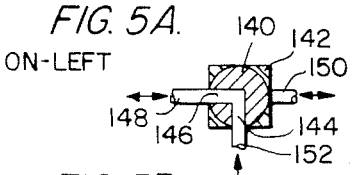
FIG. 5B.
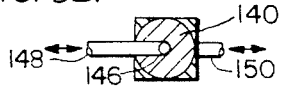
FIG. 6A.
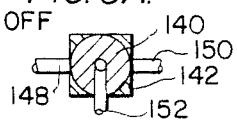
FIG. 6B.
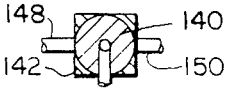
FIG. 7A.
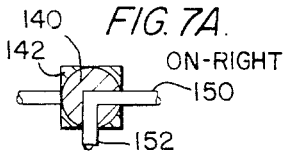
FIG. 7B.
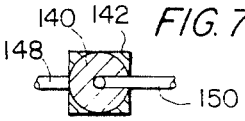

DETONATION GAS DELIVERY UNIT

FIELD OF THE INVENTION

This invention relates to an improved delivery unit for supplying through a network of fine flexible tubing to a series of explosive blasting charges adapted for gas detonation, a detonation gas formed of an explosive mixture of oxidizing and fuel gases blended from separate sources in substantially constant predetermined proportions.

BACKGROUND OF THE INVENTION

Several years ago, there was introduced to the explosive blasting field a new detonation system for detonating blasting charges, particularly a series or pattern of explosive charges disposed underground in bore holes drilled in the overburden above coal or some other mineral to be mined using conventional surface mining techniques, in which instead of detonating the explosive charges by means of electrical impulses transmitted from an electrical source through a network of wire conductors to electrically detonatable fuses associated with the explosive charges, detonation is accomplished by means of an explosive gas mixture. In this gas-initiated blasting technique, an oxidizing gas, such as oxygen, and a fuel gas, such as methane or the like, are blended in proportions necessary to form a combustible mixture and the mixture is delivered by means of small plastic tubing having, for example, an internal diameter of about ⅛ in., extending to the individual explosive charges and connected to special fuses forming part of the system and adapted to be detonated by combustion of the gas blend propagated through the tubing. After the tubing network is filled with the gas mixture, the latter is ignited within a combustion or ignition chamber communicating with the beginning of the tubing network, which chamber is equipped with a spark generating source, such as a battery operated spark plug or more preferably, a piezoelectric crystal igniter. Such a crystal igniter, as is known in the art, is capable of producing in response to mechanical impact alone an electrical spark of considerable intensity and easily sufficient to initiate combustion of the mixture without the need for a battery or like electrical source. Thus, when the gas mixture in the igniter chamber is ignited, a detonation wave is propagated throughout the tubing network to the fuses to detonate the same and thereby detonate the explosive charges themselves, either directly or by way of booster and primer charges as is known in that field. This system is disclosed in the following U.S. Pat. Nos. 3,885,499 granted May 27, 1975; 3,939,772 granted Feb. 24, 1976; 4,056,059 granted Nov. 1, 1977 and 4,073,235 granted Feb. 14, 1978, all assigned to Hercules, Inc. of Wilmington, Del., which markets components used therein under the trademark "Hercudet".

The detonation gas-activated blasting system briefly summarized above necessarily requires the utilization of thousands of feet of small flexible tubing, preferably of inexpensive plastic, such as polyethylene, including a main trunk line extending from a gas delivery unit and then branch lines as necessary to connect with the fuses for the explosive charges which are distributed usually in a pattern over the area from which the overburden is to be explosively dislodged. The number of explosive charges in the blasting pattern will, of course, vary according to the particular circumstances but can easily range from several dozen to about a hundred, all of which are to be detonated in a single blasting operation. However, the activation of the charges themselves usually does not occur precisely simultaneously but is caused to occur according to a carefully worked out delay sequence in intervals in the range of about 10–1000 milliseconds so as to reduce the force of the overall explosion to within tolerable limits, the delay being accomplished either through varying length of tubing braid lines or through time-delay devices built into the individual fuses in the known way.

The detonation gas delivery unit obviously must be portable for transportation to the blasting area and have sufficient gas volume capacity to fill the entire tubing network including trunk, branch and other line sections. The total length of the tubing network can easily reach several tens of thousands of feet, and it has been demonstrated in practice that detonation wave propagation from the common ignition point throughout the network is effective for aggregate tubing lengths well in excess of forty thousand feet. At lengths of this order, the total volume of the network is approximately 100 liters of the detonation gas blend which fixes the minimum capacity of the delivery unit for a single blasting operation.

For the protection of the public, detailed regulations are observed for the blasting industry which, among other things, requires that after an initial blasting warning signal has been given, for example, by means of a horn or siren throughout the actual blasting area and vicinity, the blasting step must be in fact completed within a reasonable time. It has been generally accepted that fifteen minutes or so meets this standard. Since the detonation gas mixture is itself combustive, introduction of the mixture into the tubing network prior to the warning signal would be unsafe; consequently, the delivery unit must accomplish the task of filing the tubing network within a relatively brief period of time consistent with completion of the blasting operation within an acceptable period after issuance of the required warning. For example, for a network with a total volume of about 100 liters, the delivery unit should have a feed rate capability of at least about 10 liters/minute, allowing the network to be filled in about ten minutes or so.

To this end, the oxidizing and fuel gases can and are supplied under considerable pressure, but this pressure is limited by the construction of the tubing arrangement itself. This arrangement includes in addition to the hollow plastic tubing various types of tubular fittings or couplings, such as L's, T's, etc., adapted to receive by a pressure fit the ends of lengths of tubing and thus permit the tubing network to be assembled to connect with the specific arrangement of explosive charges over the particular terrain in which the explosion is to take place. The tubing network must for practical reasons be adapted for assembly on site with a minimum of effort and without special time-consuming appliances or other measures; therefore, the connection and disconnection of the tubing ends with the fittings must be possible by hand. This requirement restricts the permissible tightness of the pressure fit between tubing and fittings, and hence the maximum allowable gas pressure in the network, since that pressure cannot be so great as to create a risk of blowing apart the connections of the tubing ends with the fittings.

The delivery of the detonation gas to the tubing network for the blasting charge pattern must be carried out after the charges have been placed within their bore holes and are hence inaccessible even for inspection, much less for re-connection of the tubing. If any charge should become separated from its line and detonation nevertheless effected, the result would be the presence of a so-called "loose charge", i.e., an explosive charge which failed to undergo detonation and remains in a potentially dangerous condition below ground. The regulations of the blasting industry require that all "loose charges" be recovered so as to avoid subsequent danger to workers in the area. Such recovery is expensive and time consuming inasmuch as the usual practice in placing the explosive charge is to cover the charge with earth after the same has been dropped into the bore hole and a "loose charge" must literally be dug out of the ground to be recovered. With the presently available "Hercudet" blasting initiation system, the maximum delivery pressure is approximately 40 psig.

In addition to the maximum allowable delivery pressure for the detonation gas, the proportions of the oxidizing and fuel gases employed therein have to be regulated within quite close limits to insure the creation of a mixture of oxidizing and fuel gases susceptible to combustion by spark initiation. While the specific mixture will depend on the particular gases employed, for the most commonly used gases, oxygen and a 50—50 mixture of methane and hydrogen by volume, the blend should contain at least about 50% by volume oxygen and preferably 60% but not more than about 70–75% to exhibit satisfactory combustion properties.

There are commercially available pressure regulated flow valves which are effective to supply a gas flow at a given outlet pressure and include means for sensing the outlet pressure therefrom and for adjusting the valve opening in accordance with the thus sensed outlet gas pressure. However, the effective operation of such pressure regulated valves, and indeed many other types of gas metering devices, depends upon the maintenance of a certain minimum pressure drop or differential across the valve, i.e., a certain minimum difference between its inlet and outlet pressures. It will be apparent that if such regulator valves are employed to form and feed a gas blend into a network of fine tubing at least several thousand feet in length, as described above, the tubing network will inevitably offer a substantial resistance to the flow of the pressurized gas therethrough, due to boundary layer effects, which resistance will appear as a significant back pressure acting against the outlet of the valve. Presently available pressure regulated valves are incapable of satisfactory operation against a back pressure approaching the delivery pressure, that is, when the pressure drop across the valve drops below its design limit, which is typically about 5 psi. Under the latter condition, the operation of the valve becomes unstable and thus unreliable in terms of precise metering action and control is, therefore, lost over the make-up of the detonation gas mixture. Moreover, it is virtually impossible in a practical sense to adjust a pair of such valves operating in parallel to blend two or more gases at exactly the right set points to maintain the proper gas blend, for example, 40% fuel gas and 60% oxygen, and the nature of these valves is such that when they are operated in this way, the valve having a setting exceeding its exact correct point relative to the setting of the other valve becomes pre-eminent in the operation of the valve array. As a result, the supply of the gas delivered by that valve gradually increases, while the supply of the gas passing through the other valve gradually decreases until eventually only one gas is being supplied.

Finally, the delivery unit must satisfy several practical requirements among the most important of which is the ability to operate reliably at relatively low temperatures, i.e., well below freezing. The economics of the blasting industry are such that blasting cannot be suspended on account of cold weather and hence the delivery unit must be capable of reliable operation during cold weather as well as warm weather. Also, the unit must be relatively simple to operate since although blasting technicians may be fully competent in their field, they are not trained in the handling of complex instrumentation and complexity also tends to introduce not only a greater risk of unreliability but of improper operation as well, neither of which are tolerable for blasting purposes.

OBJECTS OF THE INVENTION

The object of the invention is, accordingly, a delivery unit for an explosive gas blend useful in the gas detonated blasting systems described above which unit can operate reliably to supply a mixture of oxidizing and fuel gases within a fairly precisely defined range independently of substantial changes in the backpressure of the tubing network into which the gas is fed for transmittal to a series of blasting charges, has the gas capacity and flow rate needed to fill the tubing network quickly, can be put together into a readily portable arrangement, and is easily operated by unskilled personnel with a high degree of safety.

A further object of the invention is an explosive gas delivery unit which utilizes the backpressure of the tubing network to regulate the activation of flow valves controlling the individual flows of oxidizing and fuel gases to a common mixing point and is adapted to respond quickly to increases in such backpressure exceeding a certain limit and close the flow valves until the high backpressure condition dissipates and the pressure drop across those valves has been restored to an operative range.

Another object of the invention in a preferred embodiment is a fail-safe interconnection between the supply line and the ignition chamber of the unit with the tubing network whereby the ignition chamber is filled with the detonation gas only after the tubing network is completely filled, and the supply line and ignition chamber are adapted to be alternately connected with the tubing network so that each is isolated when the other is operatively connected.

BRIEF DESCRIPTION OF THE DRAWINGS

These and other objects and advantages of the present invention will be more fully understood from the following detailed description of the illustrative embodiments of that invention when such description is read in conjunction with the accompanying drawings in which:

FIG. 1 is a schematic flow diagram of one embodiment of the delivery unit of the invention;

FIG. 2 is a partial view of a preferred modification of the unit of FIG. 1 showing a fail-safe interconnection between the fill line and ignition chamber of the unit and the trunk lines of the tubing network;

FIGS. 3A and 3B are diagrammatic vertical cross sections of servo-actuated piston-type control valves useful in the invention, the valve in FIG. 3A having a normally open state and that of FIG. 3B having a normally closed state;

FIGS. 5A, 5B, 6A, 6B and 7A, 7B are schematic views of preferred three-way ball valves employed in both embodiments of FIGS. 1 and 2, showing such valve in three different opening positions; namely, the on-left position, an off or null position and an on-right position, respectively, the "A" views being taken on a vertical cross section and the "B" views on a horizontal cross section through the valve for each of these positions.

DETAILED DESCRIPTION OF ILLUSTRATIVE EMBODIMENT

Figure 4B:
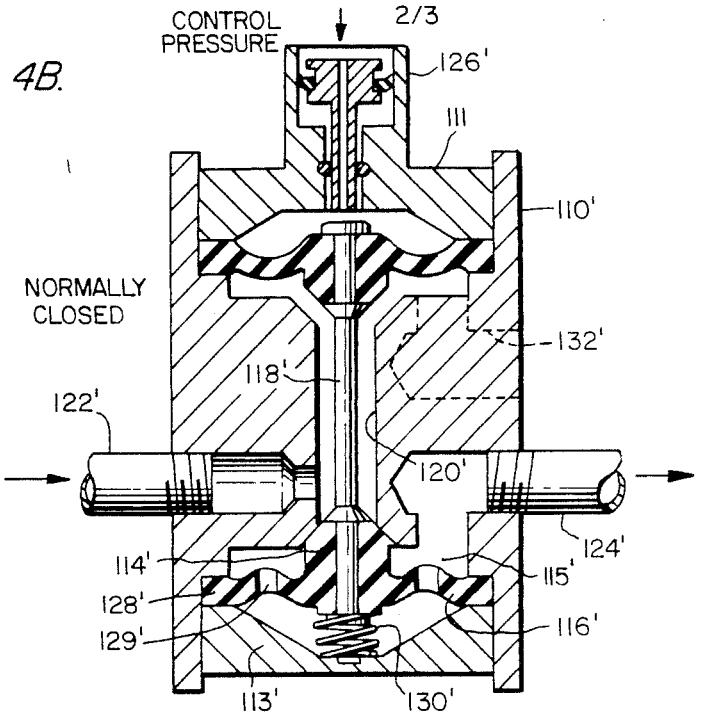
FIGS. 4A and 4B are views similar to FIGS. 3A and 3B but considerably enlarged of servo-actuated diaphragm-type control valves, the valves again being in the normally opened and normally closed state in the respective views.

Referring now to FIG. 1 of the drawings in which is shown one embodiment of the basic system of the present invention, the numeral 10 designates a contained source of oxidizing gas, such as oxygen or the like, held in a tank or other suitable vessel under substantial pressure in the order of 1000–2000 psig, such as is readily commercially available. To reduce the high source pressure of the oxidizing gas to manageable levels, the output of tank 10 is passed through a multi-stage pressure regulator consisting, for example, of a high pressure regulator 12 capable of decreasing the tank pressure to 100 or so psig and a low pressure regulator 14 for reducing the outlet pressure from high pressure regulator 12 to a suitable delivery pressure such as 40–50 psig. The outlet from low pressure regulator 14 is connected, by way of a check valve 18 permitting forward but not backward flow, to a flow control valve 16 for the oxidizing gas which in its normal condition is maintained in a closed state by suitable biasing means and is equipped with a servo actuator which when applied with a control pressure is effective to move the valve to fully open position. The details of illustrative types of valves suitable for this function will be given later. From the normally closed gas flow control valve 16, the oxidizing gas passes to an oxidizing gas metering orifice 20. This metering orifice is of a type well known in the art, taking the form of a solid plate penetrated by an aperture of predetermined area calculated to provide a predetermined volumetric flow of oxidizing gas under a given delivery pressure. The oxidizing gas leaves orifice 20 through an outlet line 21.

A similar arrangement is provided for a fuel gas, such as a methane-hydrogen mixture, including a tank 22 or other appropriate supply of such gas under a high pressure comparable to tank 10, from which the fuel gas flows through a series of high and low pressure regulators 24 and 26 and a forward acting check valve 30 to a fuel gas flow control valve 28 identical to oxidizing gas flow control valve 16, being in a normally closed state and adapted to be fully opened by means of the application of a control pressure to a servo actuator associated therewith. The output from the fuel gas flow control valve 28 passes to a fuel gas metering orifice 32 similar to that designated 20 for the oxidizing gas, the orifice area being likewise dimensioned to give the volumetric flow of fuel gas that is desired to be produced at the given delivery pressure, and leaves that orifice through an output line 33.

The gas output lines 21 and 33 from the two metering orifices 20, 32 are combined in a common line, as by means of a T-junction 34 or the like, and the mixture flows through a rotameter or other flow metering device 36 for indicating the total volume of gas flow and thence to an ignition chamber 38 containing a small amount of the gas blend and equipped with a spark generating element 40. The spark generating element can take the form of a spark plug connected to a suitable source of an electrical voltage, such as a battery or the like. However, a battery or other electrical storage device needs to be recharged or replaced from time to time, and preferably there is employed instead a piezoelectric crystal igniter. As is known in the art, a piezoelectric crystal has the property when impacted by means of a spring loaded hammer or other mechanical device of emitting a spark of sufficient intensity as to readily ignite a combustible mixture of the oxidizing and fuel gases.

From the igniter chamber, the gas blend flows to a terminal fitting or coupling 43 which is adapted to be connected in the field to the trunk line of the tubing network.

The effective size of the components described above for each of the fuel and oxidizing gas delivery lines and the conduits connecting those components must, of course, be selected to produce the total volumetric flow of the gas blend that is needed which as mentioned should be at least in the order of about 10 liters per minute. Obviously, the aggregate size of the orifice areas of the two metering orifices 20, 32 should be appropriate for this flow rate at the selected delivery pressure and the ratio of individual orifice areas to one another, such as to achieve the relative flow rates required to give the particular blend to be achieved. To give one example, the fuel orifice can have a dimension of 0.012" and the oxidizing gas orifice 0.018" to give a proportion or ratio of 40/60 of fuel gas to oxidizing gas. To achieve the latter ratio in the actual gas blend, it has been found necessary to adjust the delivery pressure of the gases fed to the respective metering orifices somewhat away from equality; if the gases have the same pressure, the blend will be found to be composed of equal volumes of the two gases because of the differences in their density. To illustrate this phenomenon, a fuel gas pressure of 47 psig and an oxidizing gas pressure of 52 psig will produce with the above orifice area a 40/60 gas blend at a combined flow rate of at least about 10 liters per minute.

In accordance with the present invention, the gas flow control valves 16, 28 are actuated in response to the backpressure of the gas blend flowing from terminal coupling 43 into the tubing network, becoming displaced to their normally closed positions when this backpressure exceeds a predetermined maximum. As explained in the introduction, when in actual operation the delivery unit of the invention is connected by coupling 43 to a lengthy network of tubing extending to the multiple blasting charges to be exploded and the flow of the detonating gas blend from the unit into the network started, a substantial pressure resistance of a magnitude depending upon the length and configuration of the network is encountered which appears as a backpressure reaching back to gas flow valves 16, 28, and as the filling of the network proceeds, this backpressure can easily reach values that would cause aberrations in the relative flow control rates of the delivery unit described above, which if left unremedied would result in deviations of the make-up of the gas blend from the desired ratio. To prevent this effect of such a backpressure, the delivery pressure of the combined gas flow is sensed, downstream of the metering orifices, for example, in the region between igniter chamber 38 and terminal coupling 43, by means of a feedback conduit 44 connected into the delivery line at a point within this region, and the pressure in this feedback conduit is employed to control the actuation of the servo actuators of the two normally closed gas flow control valves 16, 28.

To this end, a source of a compressed control gas, preferably an inert gas such as nitrogen or the like, supplied under pressure in convenient tank form designated 46 is provided, and the gas from tank 46 is delivered through high and low pressure regulators 48 and 50 as needed to reduce the control gas pressure to a usable level, for example, around 40 psig. The output from the low pressure regulator is connected to the inlet 49 of a three-way valve 51 having left and right outlets 53 and 55 adapted to be connected alternately to the inlet 49 when the valve is in its "left-on" and "right-on" positions, respectively. A second three-way valve 56 is arranged downstream of three-way valve 51 and has a bottom inlet 57 and a top outlet 58 which are alternately connected to a common port 59 when valve 56 is in its "bottom-on" and "top-off" positions, respectively. The left outlet of valve 51 is connected to the bottom inlet of valve 56 which has its common port 59 connected to the inlet of a normally open pilot valve 52. A pilot line 54 extends from the outlet of pilot valve 52 for connection in parallel to both of the servo actuators of the normally closed flow control valves 16, 28 by way of a line 61 joining the same. The top side outlet 58 of three-walve 56 is vented to the atmosphere. Thus, when the control gas source is opened and three-way valves 51 and 56 are turned to their left and "bottom-on" positions, respectively, to pass the control gas through the normally open pilot valve 52 into pilot line 54, the control gas pressure is delivered to line 61 and applied to the servo actuators of both the normally closed gas flow control valves 16, 28, moving the latter to fully open position and maintaining them in such position as long as the control pressure is present in pilot line 54. The normally open pilot valve 52 is equipped with its own servo actuator which receives the feedback pressure from the feedback conduit and the feedback pressure exceeds a predetermined maximum, the servo actuator of valve 52 is displaced shutting off pilot valve 52 and interrupting the flow of control gas into pilot line 54.

The cutting off of the control gas from pilot line 54 by the closure of pilot valve 52 alone is insufficient to effect the closure of gas control valves 16, 28 once these valves have been opened by the control gas pressure, since the existing control gas pressure continues to be held in pilot line 54 when pilot valve 52 is closed. The response to excessive delivery backpressure, hence, includes the second step of releasing the existing control pressure from pilot line 54, and for this purpose a normally closed second pilot valve 60 is connected to pilot line 54 in parallel with the normally open pilot valve 52. Pilot valve 60 is similarly equipped with a servo actuator which also receives the feedback pressure from feedback line 44, being connected to line 44 in parallel with the servo actuator of pilot valve 52, and when the feedback pressure reaches the above-mentioned predetermined maximum, that pressure likewise acts upon the servo actuator for valve 60 and displaces the same from its normally closed to an open state. This establishes communication between pilot line 54 and the atmosphere by means of a vent 62 at the outlet of valve 60 and releases the control pressure from pilot line 54.

It will be understood that the pilot valves 52 and 60 operate essentially in tandem relationship from opposite normal open and closed states, each maintaining its normal state until the occurrence of an excessive downstream pressure in the feedback conduit 44 and upon such occurrence, undergoing displacement to the opposite state to remain therein until the excess downstream pressure has dissipated, relieving the feedback pressure on the servo actuators of the pilot valves and allowing the latter to return to their normal states. As a consequence, not only is the supply of control gas to the flow control valves 16 and 28 interrupted when an excess backpressure condition occurs, but pilot line 54 is itself freed of the existing control gas pressure, allowing the gas control valves to assume their original closed state which interrupts the flow of the fuel and oxidizing gases in the unit so long as the excess downstream pressure condition exists.

Three-way valve 56 serves as a convenient way of disabling the unit, releasing when placed in its "top off" position the control gas pressure in pilot line 54 to the atmosphere via vent 58 even when the unit is disconnected from the tubing network and the existence of any backpressure in feedback line 44 is impossible, while simultaneously blocking the bottom inlet 57 of valve 56 to prevent the flow of control gas to the flow valve servo actuators.

The inert control gas from tank 46 can also be employed for testing the assembled tubing network for leaks before or after the blasting charges are lowered into the bore holes, and for this purpose, the right side outlet 55 from three-way valve 51 is joined to line 64 at a point between igniter chamber 38 and terminal coupling 43. A pressure relief valve 66 is also preferably connected to line 64 to guard against the creation in line 64 during leak testing of excessive pressure which would introduce the risk of separation of elements of the tubing network and a check valve 68 is interposed in line 64 to prevent entrance therein of the combustible gas mixture.

It is preferred that the supply or fill line of the unit to terminal coupling 43 and the ignition chamber be adapted to be isolated from each other so as to provide greater protection for the upstream components of the system against the propagation thereto of the detonation wave, and it is also preferred that a fail-safe mode for complete filling of the tubing network before ignition be incorporated into the unit. Obviously, it is necessary that the entire tubing network be completely filled with the detonation gas mixture since otherwise the possibility would exist of one or more blasting charges being undetonated by failure to receive the detonation wave created by the ignition of the gas blend in the combustion chamber. In the operation of the "Hercudet" system up to now, two general ways are available for safeguarding against incomplete filling. On the one hand, the length of time for filling operation could be extended beyond the theoretical point at which the network would be expected to be completely filled with the detonation gas, based on the estimated volume of the tubing in a particular network and the filling rate of the unit. However, the distance separating the charges can vary, and unless the exact length of tubing used is measured as the network is assembled, which would require careful attention, the amount of excess gases fed into the network would have to be quite large to give a margin of error covering the entire range of variations. Moreover, the volume of the gases is affected by the ambient temperature, introducing a further variable into the projection of the period required to completely fill a particular network and adding to the unreliability of that project.

An alternative approach is to provide the blasting charges with return lines of tubing extending outside of the bore holes and instruct the operator to check the outlet of each return line near the end of the filling operation and visually with an oxygen detector or the like confirm the flow of the gas blend therefrom. While this alternative is an effective safeguard, it requires the presence of the operator at the firing site while the tubing network is being filled and is unsafe.

In order to guarantee that the tubing network is completely filled with the detonation gas mixture before detonation and at the same time avoid the necessity for the operator to be in proximity to the tubing network during filling at all, a preferred embodiment of the invention contemplates a modification of the interconnection between the flow meter 36 for the gas blend and the igniter chamber 30 with the line to terminal coupling 43. This modification appears in FIG. 2 wherein only the righthand end of the overall flow sheet of FIG. 1 is seen, the remainder of the flow diagram being unchanged from that of FIG. 1. In FIG. 2, the delivery line from rotameter 36' and the delivery line from ignition chamber 38' are connected to opposite inlet sides of a "T" or "Y" connection 71 through separate manual shut-off valves 72, 73. The output side of connection 71 is connected through a check valve 74 to the terminal coupling 43' that is adapted for connection to the trunk line of the tubing network when the unit is set up for actual operation. The inlet to ignition chamber 38', instead of being joined in the main gas flow path as in FIG. 1, is isolated from that flow path and is connected to a separate inlet line 77 including a check valve 79 permitting flow only toward chamber 38' and ending in a separate terminal fitting or coupling 78 which is adapted to be coupled to a return trunk line extending as a part of the tubing network from the ends of return tubing lines from the various explosive charges. Ignition chamber 38' has an alternative outlet which is vented to the atmosphere through a vent 80 that can be opened or closed by a manual shutoff valve 82. A by-pass line 81 is connected at one end to the inlet line 77 at a point between the terminal fitting and check valves 79 and at the other to vent 80.

It will be understood that in the operation of the preferred modification of FIG. 2, the valves 72, 73 are alternately opened and closed so as to first establish communication directly between the detonation gas mixture delivery line from rotameter 38' and terminal coupling 43', and thence to the main delivery trunk line of the tubing network, while isolating ignition chamber 38' from the flow path of the gas blend. During this phase, valves 73 and 76 are closed and valves 72 and 82 are opened so that the return flow of the combustible detonation gas mixture from the explosive charges is passed into the ignition chamber to fill the same and eventually exhaust through vent 80. By observing the output from vent 80, for example, with a standard oxygen meter, one can determine when the ignition chamber is completely filled with the detonation gas signifying complete filling of the tubing network. Obviously, the operation of modified interconnection is simplified when the array of explosive charges is connected in series into the tubing network, which is the ordinary arrangement, so that the return line of each explosive charge serves as the supply line for the next charge until the last charge which has its return line connected back to the return terminal 78 since in this case the detonation gas could not appear in the ignition chamber until the entire line has been filled. However, the preferred embodiment is also useful in principle with other patterns of tubing networks in which the explosive charges are for instance connected in parallel by following appropriate safeguards that would be necessary in any case for such patterns to insure that each branch line receives the gas and is not "short-circuited" by another branch line.

After the network and the ignition chamber have been filled, and preparatory to ignition or firing, valve 72 is closed to isolate the gas supply flow from the ignition chamber 38' while valve 73 is opened to establish communication between chamber 38' and the trunk line terminal coupling 43' and thence to the tubing network. Then, valve 82 is closed so as to confine along with check valve 79 the detonation to the gas within chamber 38' and insure that the propagation of the combustion wave takes place properly through the trunk line, and valve 76 is opened to allow the inlet line 77 and thus the return line of the tubing network to vent to the atmosphere.

All of the components utilized in the units described above can be, and preferably are, readily available commercial articles, e.g., the various pressure regulator valves, flow valves, check valves, three-way valve, pilot valve, etc., and a detailed explanation of the construction of these commercial elements is accordingly unnecessary. However, for the sake of more complete understanding and to avoid confusion, the more important of these elements have been illustrated in generally schematic fashion in the drawings and will be briefly described. As regards the gas flow control valves as well as the pilot valves, all of which include servo actuation means, while the valves employed for these separate functions can be different, they can quite conveniently be of the same general type except, of course, for the opposite normal state of one of the pilot valves as specified above; and two general types of commercial valves useful for this purpose of the invention are illustrated in FIGS. 3A, 3B and 4A, 4B, respectively. It should be understood that these illustrations are not intended to imply any restriction of the invention to these two types of valves alone, as other kinds of valves are undoubtedly equally available and equally effective here.

Figure 4A:
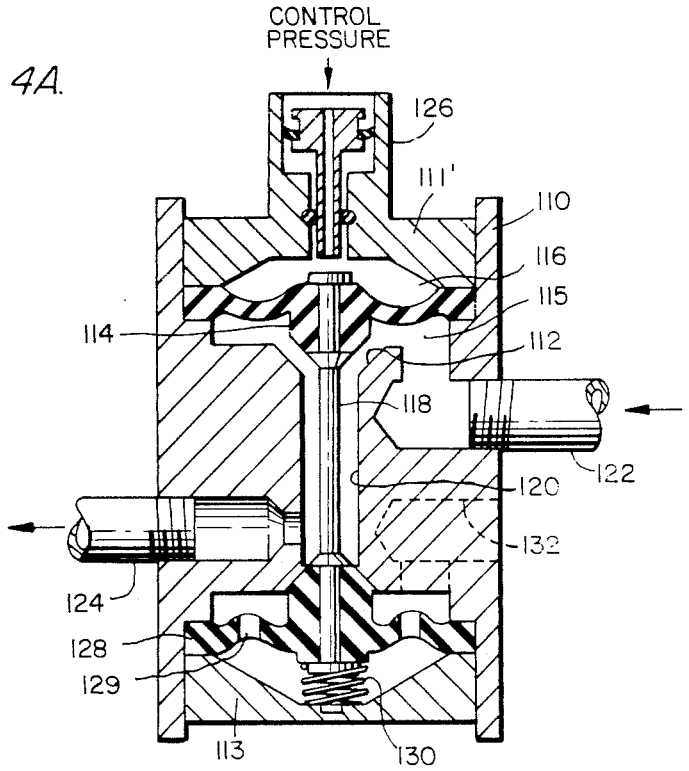

In FIGS. 4A and 4B, the valves are of the piston type, that of FIG. 4A having a normally open state and that of FIG. 4B a normally closed state and being otherwise similar. Each such valve has a housing 90, 90' having an inlet port 96, 96' and an outlet port 98, 98' and enclosing an operating piston head 92, 92'. Head 92, 92' is biased as by means of a spring 94, 94' to its normal position which in FIG. 4A is disposed clear of the inlet and outlet ports so that a gas flow applied to the former will pass freely through the latter; while in FIG. 4B head 92' is positioned to close these ports and block flow therebetween. Operating piston 92, 92' is connected through a rod 100, 100' to a servo piston head 102, 102' disposed toward the bottom of housing 90, 90'. A servo or control pressure line is connected to the lower end of housing 90, 90' as at 104, 104' and a control gas admitted through line 104, 104' is applied to servo piston head 102, 102' in opposition to the bias of spring 94, 94'. As the control gas pressure reaches a sufficient level, the biasing force of spring 94, 94' is overcome displacing operating piston head 92, 92' from its normal state. Thus the effect of the control gas pressure is to shift the normally open operating piston head 92 to a position blocking its inlet and outlet ports and the normally closed piston head 92' to an open position, placing the corresponding inlet and outlet ports in communication. When the control gas pressure is removed from the control ports, the operating heads return to their normal open or closed state by the action of the springs 94, 94'. The extreme positions of the operating piston heads in their normal state may be limited, for example, by stop shoulders 106, 106' to establish a clearance space adjacent the lower faces of the servo piston heads 102, 102' to facilitate application of the control pressure thereto. It will be understood that schematic views of FIGS. 3A and 3B are not intended to represent the actual construction of specific commercial units which will normally include O-ring seals and various other refinements, as is known in the art, none of which is shown in these views.

A different type of servo-actuated valve is illustrated in FIGS. 4A and 4B, which is of the servo-diaphragm actuated "poppet" type and here again both a normally closed and a normally open valve are shown for illustration.

Each such valve includes a generally cylindrical housing body 110, 110' having a central bore 120, 120' extending generally axially through the interior of the housing body. A radially directed inlet port 122, 122' penetrates the housing wall and communicates at its inner end with bore 120, 120'. One end of the bore is flared outwardly, as at 112, 112' so as to form a valve seat which is adapted to cooperate with an adjacent working valve head 114, 114' which is tapered for leak-proof engagement with the seat. The valve head is mounted for limited movement relative to its seat at the center of a flexible diaphragm 116, 116', and preferably formed integrally therewith, the diaphragm having its peripheral margins anchored in the housing walls. Defined between the seat 112, 112' and the adjacent face of diaphragm 116, 116' is an annular chamber 115, 115' which is in communication with an outlet port 124, 124' passing radially through the housing body wall. A poppet stem 118, 118' is affixed at one end to the valve head 114, 114' and extends coaxially through the central bore 120, 120' for free axial movement therein, a compression spring 130, 130' maintained under compression being disposed in the housing for engagement with an end of the stem, the spring being so as to urge the poppet stem and the associated valve head in a direction according to the normal state of the valve. In the normally open valve of FIG. 4A, the spring 130 bears on the end of the poppet stem opposite from valve head 114 to urge the latter away from seat 112, while in the normally closed valve of FIG. 4B, the spring bears on the end of the poppet stem affixed to the valve head 114'. In either case, the end of the poppet stem opposite valve head 114, 114' is connected to the center of a second flexible diaphragm 128, 128' likewise having its peripheral margins anchored in the housing wall and situated in axially spaced relation to the first diaphragm 116, 116' adjacent the opposite end of bore 120, 120'.

In the normally open valve of FIG. 4A, the diaphragm 116 associated with the valve head 114 itself exercises a servo function in the operation of the valve; while for the normally closed valve, it is the opposite diaphragm 128' that serves the servo function. In either case, the diaphragm adjacent the biasing spring 130, 130' is perforated as at 129, 129' which maintains a pressure equilibrium on its opposite sides and avoids variations in the response of the valve that might otherwise occur. The end wall adjacent the servo-acting diaphragm of each of these valves, i.e., wall 111, 111', is provided with a control port 126, 126' for the delivery therethrough to the opposite side of the servo-acting diaphragm of a control gas pressure which is effective to displace such diaphragm and cause the valve head 114, 114' to move to its opposite position relative to seat 112, 112'.

Thus, valve head 114 which in the normally open valve of FIG. 4A is held away from seat 112 to place the outlet port 124 in free communication with the valve bore 120 and thence with inlet port 122, is displaced under control gas pressure against seat 112 to close the valve and prevent further flow between its ports. Contrariwise, in the normally closed valve of FIG. 4B, the valve head 114' which is normally seated against seat 112' to block the valve ports, is shifted by the control gas pressure to open position to permit flow between its ports.

While the control gas can be applied directly to the servo diaphragms of the valves in question, preferably, the poppet type valves are utilized in association with a booster piston assembly 127, 127' interposed in the control gas port adjacent the servo-acting diaphragm so as to multiply in a known way the effective pressure exerted by the control gas and thereby reduce the magnitude of the control gas pressure necessary to produce a change in the state of the valve itself.

Typically, commercial poppet type valves of the type shown in FIGS. 4A and 4B are designed to be "double acting" and include for this purpose an exhaust port intended to be placed in communication with the outlet port when the working piston head is seated against the valve seat. However, for purposes of this invention, the exhaust function is unnecessary and if a commercial valve is selected which includes an exhaust port, that port is securely plugged as indicated by dotted lines at 132, 132'. Such "double acting" valves necessarily include a second valve head associated with each of the opposite diaphragms 128, 128' for cooperation with a tapered valve seat formed at the opposite ends of each central bore which works in opposition to the main valve head and controls the connection between the output and exhaust ports. While for purposes of the invention, such secondary heads have no active function, their presence is not objectionable and indeed advantageous in achieving more stable operation of the valve by stabilizing the reciprocation of the poppet stem during operation.

It has been found that either of the types of valves illustrated in FIGS. 3A, 3B and 4A, 4B can be employed for both the flow control and pilot valve functions of the invention, appropriately chosen, of course, with regard to the normal state necessary for the particular function. Thus, a normally closed piston valve of the type of FIG. 3B or a normally closed poppet valve of the type of FIG. 4B can serve as the gas flow control valve as well as the normally closed pilot valve. On the other hand, a normally open piston valve as in FIG. 3A or poppet valve as in FIG. 4A can be employed as the normally open pilot valve. It is to be emphasized that the flow through each of the valves in the system of the invention has strictly a single-acting function and not a two-way double-acting function. Specifically, the normally closed gas flow valves open in response to control gas pressure to permit gas flow only in the downstream direction, the pilot valve which is normally open to direct control gas pressure to the gas flow control valves closes to interrupt that control gas flow, and the normally closed pilot valve opens to permit flow of the control gas from the pilot line to the atmosphere only.

It will be appreciated that whatever type of valve is selected, a certain amount of adjustment of the valve elements will be needed in order to calibrate the operation of the valve to suit the needs of the invention. That is to say, some adjustment may well be needed to insure that the pilot valves respond at the desired level of feedback pressure from the gas mixture delivery line and, similarly, that the gas flow control valves respond at the correct pressure applied by the control gas pressure through the pilot line. The former will obviously be the more critical, since the control gas pressure can be rather easily set at sufficiently high operative levels to overcome the spring resistance, and some experimentation may be necessary to arrive at a proper actuation point for the two pilot valves. This may be done by either adjusting, where possible, the biasing force of the compressor spring, or substituting a spring with a different spring constant more in keeping with the design requirements of the system, Also, since the valves normally have a one-way function, they can be connected in either direction, i.e., the inlet and outlet ports can be reversed, since that direction may influence the valve behavior, especially for poppet type valves.

A suitable three-way valve for controlling the flow of control gas is shown diagrammatically in three operating positions in FIGS. 5A, 5B, 6A, 6B and 7A, 7B. This valve has an inner ball element 140 rotated by a handle (not shown) about a vertical axis in a housing 142, the ball having an L-shaped passageway therein including a vertical coaxial leg 144 opening at its bottom and a horizontal leg 146 extending from the ball periphery to the inner end of the vertical leg. The housing includes opposite left and right ports 148 and 150 which can be alternately placed in communication by rotation of ball 140 with a common port 152. As suggested by the arrows in FIGS. 5A, 5B, the various ports 148, 150, 152 can function either as an inlet or an outlet dependent upon how the valve is connected. FIGS. 5A, 5B are vertical and horizontal across sections, respectively, of the valve in its "left-on" position, connecting port 152 and left port 148, while blocking right port 150. FIGS. 6A, 6B are similar views of the valve in its "off" position with the horizontal leg at a null or intermediate inoperative position, blocking all ports, while FIGS. 7A, 7B are similar views of the valve in its "right-on" position, putting the inlet 152 and right side port 150 in communication, while blocking port 148. The terms "left" and "right" are used for descriptive purposes and different directional terms would apply if the valve orientation were changed, e.g., as with valve 56.

In principle, a similar three-way valve could be useful in the modified embodiment of FIG. 2 in lieu of connector 71 to alternately connect the rotameter 36' and the igniter chamber with the gas delivery line. However, experiments employing a commercial valve of this type at this point resulted in spontaneous combustion of the gas blend under certain conditions, which cannot be explained by presently available information but could create a serious hazard.

Figure 8:
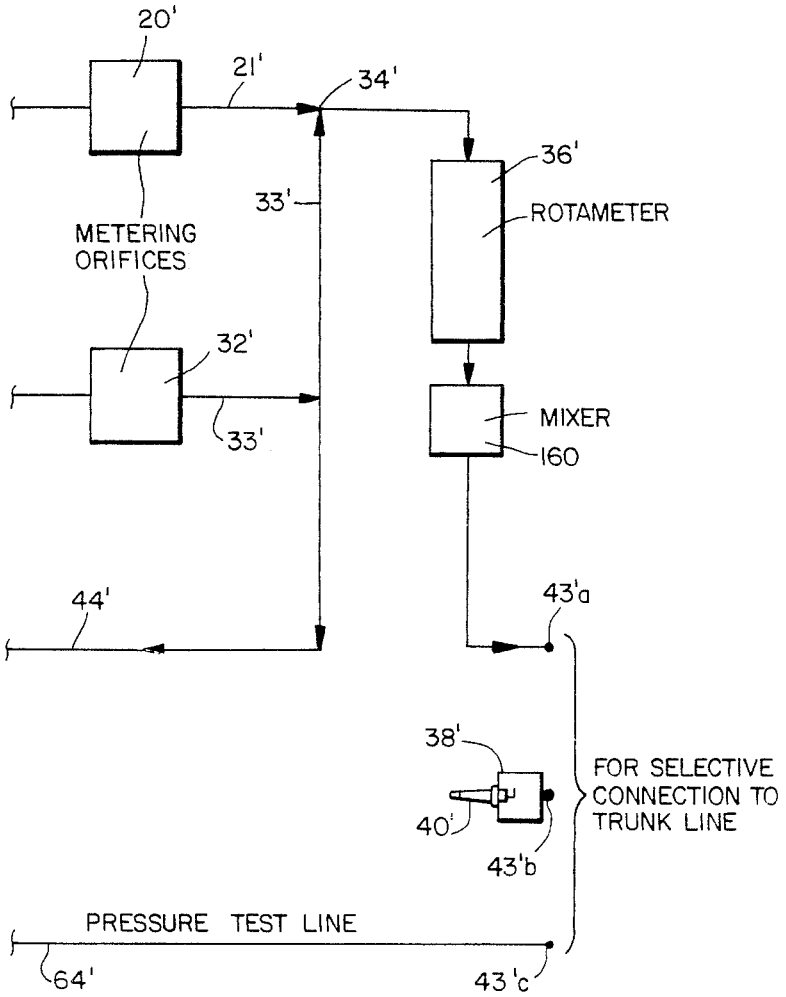
FIG. 8 is a partial view of a simplified variation of the fail-safe modification of FIG. 2.

FIG. 8 represents a simplified variation of the preferred embodiment of FIG. 2 in which the most important safeguards afforded by the FIG. 2 arrangement are retained in less complex manner and certain additional safeguards achieved. As in FIG. 2, FIG. 8 includes only enough of the main flow diagram of FIG. 1 as to facilitate its association therewith and like parts are given prime designations similar to FIG. 2 to aid in that association. In FIG. 8, the junction or interconnection between the gas flows from the respective metering orifices 20, 32, instead of being situated as appears in FIG. 1, and by incorporation in FIG. 2, in balanced relation to the delivery lines 21, 33, is placed directly in series with the oxidizing gas delivery line 21', as at 34', with the fuel gas delivery line 33' making a branched connection therewith. As before, the backpressure line 44' for sensing the working line pressure of the gas blend during the filling of the tubing network is branched from fuel gas delivery line 33'. The effect of this change is to further guard against the intrustion into backpressure line 44' of any of the oxidizing gas, the separation of the joint between backpressure line 44' and line 33' from the mixing interconnection 34' being sufficient to act as an effective barrier to the migration of the oxidizing gas into line 44'. This does not, however, impede the function of backpressure line 44' since during the filling operation the pressure throughout the region of the flow path downstream of the metering orifices must be in equilibrium with the pressure in the remainder of the system so that the backpressure sensed in line 44' is that present in the gas blend downstream of interconnection 34' despite the fact that only the fuel gas is present in line 44'.

From mixing interconnection 34', the gas blend passes through the rotameter 36' as before and in this simplified arrangement preferably to a mixing chamber 160. The gas flow in the unit of the invention has been found to be substantially laminar in nature, and it is consequently advantageous that provision be made for insuring the creation of a homogeneous blend of the two gases before that blend passes through the outlet terminal into the tubing network. In the embodiment of FIG, 1, the ignition chamber itself supplies this mixing function but, in the preferred arrangement, as already explained, the ignition chamber is isolated from the gas flow path. Hence, the provision of a separate mixing chamber 160 is desirable to temporarily retard and expand the gas flow to set up a certain turbulence in such flow and thus bring the gas components into uniform admixture. Only a small volume, such as about 100 cc, is sufficient for this purpose. From mixing chamber 160 the gas is delivered to a terminal outlet coupling similar to that designated 43 in FIG. 1. However, in the varient embodiment of FIG. 8, three separate terminal couplings are utilized, one for each of the three separate functions served by the single coupling 43 in FIG. 1, and, accordingly, these three outlets are designated 43'*a, b* and *c* to convey this identity but at the same time indicate their particularity.

The ignition chamber 38' is in FIG. 8 completely independent of the gas flow path of the unit and has only an outlet connected to a separate terminal coupling 43'*b*. Similarly, the pressure test line 64' extends to a separate outlet terminal 43'*c*. It will be obvious that the respective outlet terminals 43'*a, b* and *c* will be connected in the field one by one to the end of the flexible trunk line of the tubing network so that only one of them is operatively joined to the tubing network at a given time. Specifically, the inlet of the main trunk line of the tubing network will in normal practice be first connected after assembly of the network to the outlet terminal 43'c so that the control gas can be delivered into the tubing network by manipulation of three-way valve 51 and the integrity of the tubing network tested by checking the presence of outflow of such gas at the return line of each of the individual explosive charges. After the pressure test has been satisfactorily made, the inlet end of the tubing network is disconnected from coupling 43'c and connected to terminal coupling 43'a and the filling operation of the network carried out in the same manner as with the system of FIG. 1. Then, after the network is completely filled, the inlet end of the tubing network is disconnected from coupling 43'a and connected to coupling 43'b at the outlet from the ignition chamber 38'. It has been found that the delivery to the ignition chamber of a flow of the gas blend from the delivery unit itself is not necessary; rather, the volume and pressure of the gas blend in the tubing network has proved sufficient to fill that chamber provided its volume is made relatively small and the ignition point located as closely as possible to terminal fitting 43'b. To this end, the spark generating element 40' is preferably situated virtually within the outlet coupling 43'b so that in effect, the inlet end of the tubing network forms part of the ignition chamber which has been found quite satisfactory in practice. Obviously, in switching the tubing network inlet from terminal 43'a to terminal 43'b, the open end of the tubing inlet should not be left open to the atmosphere for longer than a few seconds and more preferably, is blocked as with a finger, while transferring the network inlet from one coupling to the other.

As is implicit in the preceding explanation of FIG. 8, the volume of the ignition chamber need not conform to some predetermined minimum, as might otherwise be expected, and indeed satisfactory ignition of the detonation gas blend is achieved without regard to any particular volume for that chamber. Apparently, all that is required is that the gas blend at the inlet end of the tubing network be exposed to a spark or other ignition conditions for effective detonation to begin at that point and be propagated throughout the length of the tubing network.

It will be understood that the delivery unit described above lends itself well to a hand-carried portable arrangement, being completely self-contained and assembled of parts which can be relatively small and lightweight. To this end, the several supply vessels 10, 22, 46 need have only a modest volume, say 20 ft.$^3$ of each pressurized gas under standard conditions, as they can be refilled from time to time from supply sources of greater volume, carried on a truck or other vehicle.

I claim:

1. A delivery unit for supplying a combustible mixture of fuel and oxidizing gases in a predetermined proportion to a series of gas-detonated explosive charges via a network of tubing including a main trunk line, said unit comprising individual sources of fuel and oxidizing gases; pressure regulating means for establishing a given supply pressure for each of said gases; separate normally closed flow control valves for controlling flows of each of said fuel and oxidizing gases at said given supply pressures and having pressure-operated servo means associated therewith for opening the same; a metering orifice for each of said gas flows, the area of each said orifice being predetermined to meter the volume per unit time of such gas flow passing therethrough at said given supply pressure; at least one terminal fitting receiving a mixture of said metered gas flows and adapted to be connected to the main trunk line of said tubing network to deliver said gas mixture into said network and thence to said series of blasting charges; an ignition chamber adapted for communication with one such terminal fitting, said chamber including spark-generating means therein for igniting the gas mixture in said trunk line, whereby the resultant combustion wave propagates through the tubing network to detonate said explosive charges; and control means for said flow control valves to maintain a minimum pressure differential between the inlet and outlet pressures thereof, said control means comprising a separate source of an inert control gas for delivering a flow of control gas, and pressure regulating means therefor for establishing a given control pressure for said control gas flow, and pilot valve means effective to normally apply said control gas pressure simultaneously to the servo means for both said flow control valves to open the latter and operable in response to the occurrence of a backpressure in the flow of said gas mixture through said terminal connection exceeding a predetermined maximum to release said control gas pressure from both said flow control valve servo means to cause the flow control valves to revert to their normally closed state and interrupt said gas flows into said tubing network until said excessive backpressure is dissipated.

2. The system of claim 1, wherein said pilot valve means comprises a normally open pilot valve connected on one side to said control gas pressure regulating means and on the other to the servo means of both said flow control valves, whereby said control gas pressure is effective upon its delivery to said pilot valve to open both said flow control valves for flow of said operating gases therethrough; a normally closed pilot valve connected on one side to the servo means of both said flow control valves in parallel with said normally open servo valve and on the other to the atmosphere, each said pilot valve including pressure operated servo means for moving the same to an opposite state; and feedback conduit means for applying to the servo means of each of said pilot valves the delivery pressure of said gas mixture to operate the said pilot servo means when said feedback pressure exceeds a predetermined maximum pressure, whereby in the latter event said normally open pilot valve is closed to cease the flow of control gas to said flow control valve servo means and said normally closed pilot valve is opened to release to the atmosphere the control gas acting on said flow control valve servo means and permit said gas flow control valves to return to their normally closed state until said feedback pressure drops below said predetermined maximum pressure.

3. The unit of claim 1 wherein said ignition chamber is connected in series between said metering orifices and the flow of gas mixture passes through said chamber on the way to said terminal fitting.

4. The unit of claim 1 wherein said tubing network includes a return line from said series of explosive charges, said ignition chamber has a filling inlet and an ignition outlet, said inlet being connected to an inlet terminal adapted to be connected to said return line, and valve means effective to alternately place said outlet terminal in communication with said metering orifices and with the ignition outlet of said ignition chamber, whereby said chamber can be isolated from the delivery flow of said gas mixture and can be filled through said filling inlet with said gas mixture from said return line after the tubing network is filled therewith, and said metering orifices can be isolated from said ignition chamber during ignition through said ignition outlet.

5. The unit of claim 3 wherein said ignition chamber includes an alternative outlet and valve means operable to connect said alternative outlet to the atmosphere, whereby said alternative outlet can be opened to facilitate filling of the chamber with the gas mixture and then closed for ignition.

6. The unit of claim 1 wherein said ignition chamber is detached from the remainder of the unit and has an outlet and further comprising first and second terminal fittings, means connecting said first terminal fitting to said metering orifices to deliver the gas mixture through said fitting to said tubing network when the trunk line of such network is connected thereto, and means connecting said second terminal fitting to said ignition chamber outlet whereby said trunk line after filling of the network with said gas mixture can be disconnected from said first fitting and connected to said second fitting for ignition of the gas mixture therein.

7. The unit of claim 1 including means for delivering a flow of a pressurized inert gas to one such terminal fitting whereby the tubing network can be tested for leaks prior to filling of the same with the gas mixture.

8. The unit of claim 7 wherein said inert gas also serves as said control gas and including conduit means for connecting said control gas source to said terminal fitting independently of the flows of fuel and oxidizing gases and valve means for selectively directing the flow thereof to said pilot valves and said conduit means.

9. The unit of claim 8 including a separate terminal fitting for said control gas.

* * * * *